United States Patent [19]

Cotton, Jr.

[11] Patent Number: 4,604,108

[45] Date of Patent: Aug. 5, 1986

[54] AIR WASHER AND METHOD

[75] Inventor: Worth B. Cotton, Jr., Greensboro, N.C.

[73] Assignee: Industrial Air, Inc., Greensboro, N.C.

[21] Appl. No.: 325,703

[22] Filed: Nov. 30, 1981

[51] Int. Cl.[4] ..... B01D 3/04

[52] U.S. Cl. ..... 55/20; 55/224; 55/227; 261/DIG. 34

[58] Field of Search ..... 55/20, 224, 227; 261/DIG. 34

[56] References Cited

U.S. PATENT DOCUMENTS

| | | | |
|---|---|---|---|
| Re. 20,944 | 12/1938 | Baker | 55/227 X |
| 1,797,256 | 3/1931 | Boardman | 55/227 |
| 1,955,406 | 4/1934 | Carrier | 261/DIG. 34 X |

*Primary Examiner*—Tim Miles

*Attorney, Agent, or Firm*—Charles R. Rhodes; Judith E. Garmon

[57] ABSTRACT

A generally conventional air washer is modified by dividing the water delivered to a bank of sprays into a first portion that is directed to a header at the top of the bank and a second portion that is directed to a header at the bottom of the bank. A throttling valve is placed in the line upstream of the upper header. When the air washer is being used as a dehumidifying apparatus, as in summertime use, and during situations of minimum use as a dehumidifier, the water supply to the upper headers may be throttled or even cut off completely without affecting the water pressure to the lower header. Water from the lower nozzles in such situations continues to be emitted into the air stream as an atomizing spray.

5 Claims, 2 Drawing Figures

AIR WASHER AND METHOD

BACKGROUND AND SUMMARY OF THE INVENTION

Air washers are a conventional piece of apparatus utilized in humidity control in industrial and commercial systems. A conventional air washer includes one or more banks of nozzles placed in an air stream to be treated, which nozzles receive chilled water under pressure from a source and atomize the water into a spray that is introduced into the air stream. In normal or humidifying operations, moisture from the spray is picked up by the air stream as a result of evaporative cooling.

During summertime operations, the same air washer can be used as a dehumidifying apparatus. In such situations, the return air is generally higher in humidity than desired, and therefore if the spray water is maintained at a cooler temperature than the air stream, moisture from the air stream will condense on the tiny water droplets, which are subsequently removed from the air stream, resulting in less moisture in the air stream provided back to the work area.

When the air washer is being utilized as a dehumidifying device, sometimes it is necessary to remove more moisture than at other times. When the amount of moisture to be removed from the return air is small (minimum spray condition), a problem occurs because while the number of water droplets must be reduced, the water pressure must still be high enough to maintain atomization. Therefore, in one approach, by merely reducing the water pressure through throttling valves, complete atomization may not occur. In such a case, the opposite result, i.e. evaporative cooling will occur and the return air stream will actually pick up moisture.

In a first attempt to overcome this problem, it was attempted to shut off certain lower ones of the spray nozzles leaving only the upper nozzles active, even though the pressure was maintained on the upper nozzles to promote atomization. While moisture will initially condense in the upper regions of the air stream, by the time the droplets fall to the collecting tank below, evaporative cooling will again occur, thus adding moisture to the return air stream.

In the present approach, which has been found to be effective, the water supply is divided into one branch which is directed to an upper header, thereby feeding water to upper ones of the nozzles in a bank. The other branch of water is directed to a lower header that feeds the lower nozzles. The branch pipe to the upper header is provided with a throttling valve upstream of the upper header, so that the water pressure may be reduced thereto or even shut off completely. Even though the upper nozzles may be shut off, atomization still occurs through the lower nozzles. The droplets emitted by the lower nozzles will condense sufficient moisture from the air stream to achieve the minimum dehumidification necessary.

In a preferred approach, the throttling valve to the upper header is activated responsive to a thermostat in the work area being controlled. When the thermostat indicates that the temperature is decreasing past prescribed limits, the throttling valve is activated to begin reducing the supply of water to the upper sprays until the temperature rises back above the prescribed limit. It may even be necessary to shut off the upper sprays completely to maintain temperature above the prescribed lower limit. However, should this occur, the supply of water to the lower nozzles is maintained at sufficient pressure to effect atomizations and achieve the desired dehumidification result.

It has also been found in a preferred embodiment that the nozzles being supplied by the lower header which are not shut off or throttled should make up a minor portion of the total number of nozzles (10–15%).

It is therefore an object of the present invention to provide an improved apparatus and method for operating an air washer as a dehumidification device even during times of minimum spray conditions and prevent humidification during such times as a result of evaporative cooling.

It is a further object of the present invention to provide an apparatus and method of the type described in which the desired result is achieved by throttling or shutting off the water supply to a major portion of the nozzles of the air washers while maintaining the water supply at normal pressures to a minor portion of nozzles that are positioned in the lower regions of the air stream.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
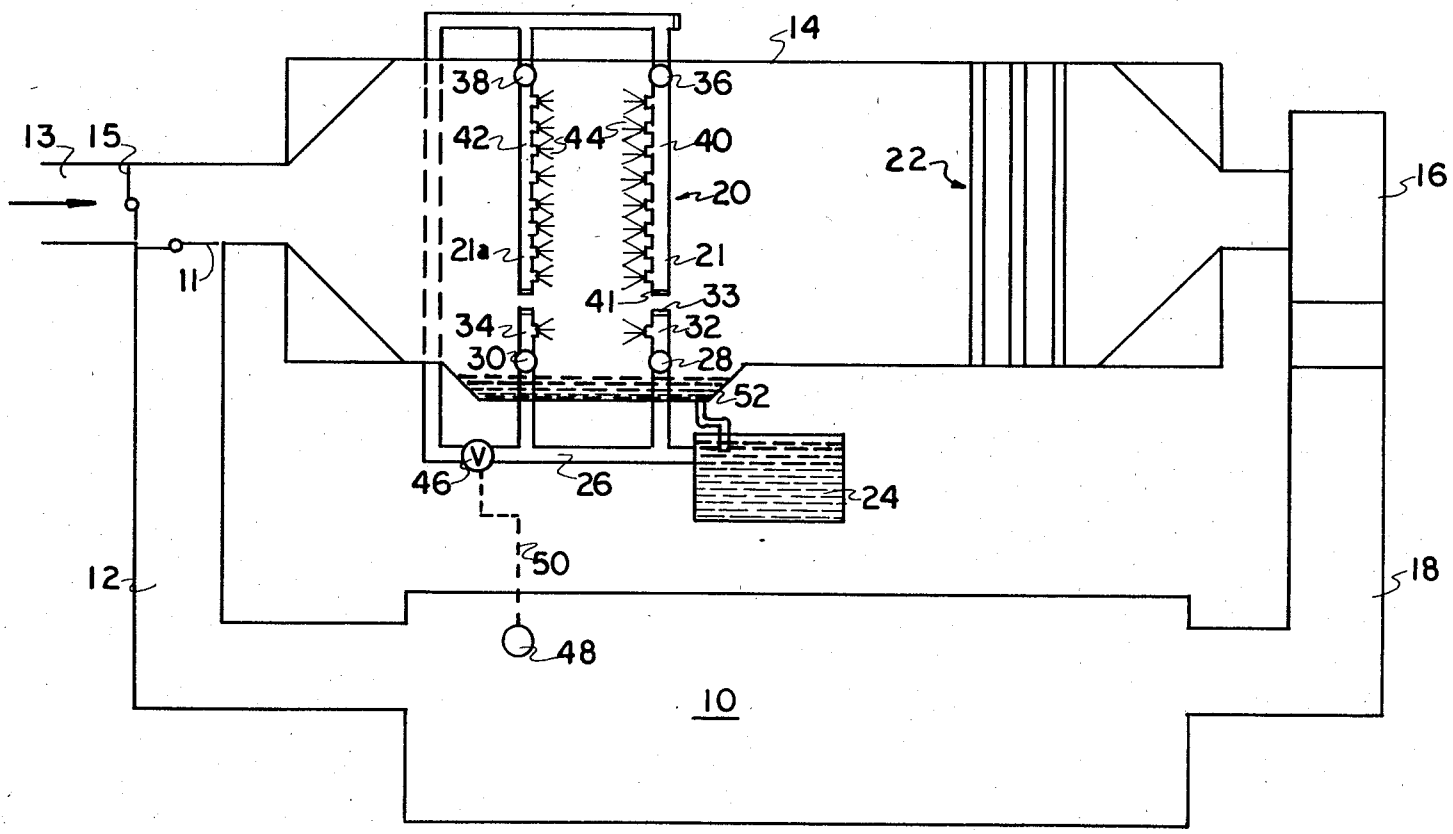
FIG. 1 is a schematic representation of a preferred embodiment of the present invention.

Turning now to FIG. 1 there is illustrated schematically the present invention in the environment of an air treatment loop which includes, as is conventional, a work area 10 to be served, a duct 12 for returning air from the work area 10 to the air treatment housing 14. Outside air may also be introduced to the housing 14 through duct 13 which intersects duct 12. The mixture of air from the outside and from the served area 10 is controlled by dampers 11,15. However, during summer operation outside air will generally not be used and the air entering the air washer will be entirely from work area 10. After treatment in housing 14, the treated air is moved by a fan or blower 16 back through a make-up air duct 18 into the work area 10. Further, as is conventional in air treatment loops, there is provided an air washer 20 and a set of eliminator blades 22 which remove the moisture droplets from the treated air prior to the time the air enters fan 16. Of course, other air treatment devices such as heaters, chilling coils, and the like may be utilized. However, are not considered to be necessary to an understanding of the present invention.

The present invention differs from the structure of previous known apparatus in the construction of the air washer 20 and the manner in which the cooling water is delivered thereto. First of all, one or more banks **21,21*a* of air spray nozzles are provided to deliver atomized water into the air stream for various reasons as described hereinabove. In the present invention, each bank 21,21*a* is divided into upper and lower sets of nozzles. For example, in the right-hand bank 21, a lower header 28 receives water from a source 24 and delivers it to one or more upright pipes 32 from whence it exits through nozzles 44. An upper header 36 also receives water from the source 24 and delivers the water through one or more upright pipes 40 to the nozzles 44 in the upper portion thereof. As can be seen, in the preferred embodiment, the nozzles 44 in the upper branch or branches 40 considerably outnumber those in the lower branches 32 for reasons to be described hereinafter. The upright pipes 32 and 40 can either be terminated at points 33,41 or else an intermediate wall (not shown) may be placed in a continuous pipe to divide it into an upper and lower section. In any event, it is desired that the pipe 40 and pipe 32** be isolated from each other as far as allowing water from one pipe to enter the other is concerned.

The second bank 21*a* is similar to bank 21, in that there is provided a lower header 30 which receives water from source 24 and delivers it to an upright member 34. Likewise there is an upper header 38 which receives water from the same source 24 and provides it to one or more upright pipes 42. While a pair of banks 21,21*a* is preferred, there may be one bank, or more than two, as desired.

In addition to the isolation of the upper pipes 40,42 from lower pipes 32,34, there is provided a throttle valve 46 in the conduit 26 upstream of headers 36,38 toward the water source 24 and downstream of headers 28,30. In such an arrangement, the water to the upper headers 36,38 may be throttled or even shut off without affecting the supply of water to lower headers 28,30. Of course a sump 52 is provided to receive the water droplets as they fall from the air washer 20.

Valve 46 is connected to a pneumatic dry bulb thermostat 48, positioned in the area 10 to be served and connected thereto by a pneumatic line 50. So arranged, the throttle valve 46 may be operated responsive to prescribed changes in dry bulb temperature in the served area in a well known manner.

In operation, during those times of summer operation when minimal dehumidification is needed, if too much cooling spray is being provided into the return air, the temperature within served area 10 will begin to fall. When the temperature falls below prescribed limits, the thermostat 48 will signal throttle valve 46 and begin to throttle the supply of water to the upper headers 36,38. If the temperature is still below the prescribed limits, the throttle valve 46 will close entirely leaving only a supply of water to the lower headers 28,30. This supply of water is not throttled at all, therefore sufficient pressure will be exerted on the nozzles 44 in branches 32,34, so that complete atomization will occur. Even though a minor portion (10–15%) of the total spray nozzles are in the lower branches 32,34, sufficient dehumidification will occur because of mixing in the fan or in the downstream ductwork. Also, since the nozzles left on are in the lower regions of the air treatment housing 14, there will not be time for evaporative cooling to occur between the time the spray from the lower nozzles is emitted and falls into the sump 52. This condition could occur if the situation were reversed and if the minor portion of nozzles 44 remaining on during minimum spray conditions were in the upper regions of the air treatment housing 14.

Figure 2:
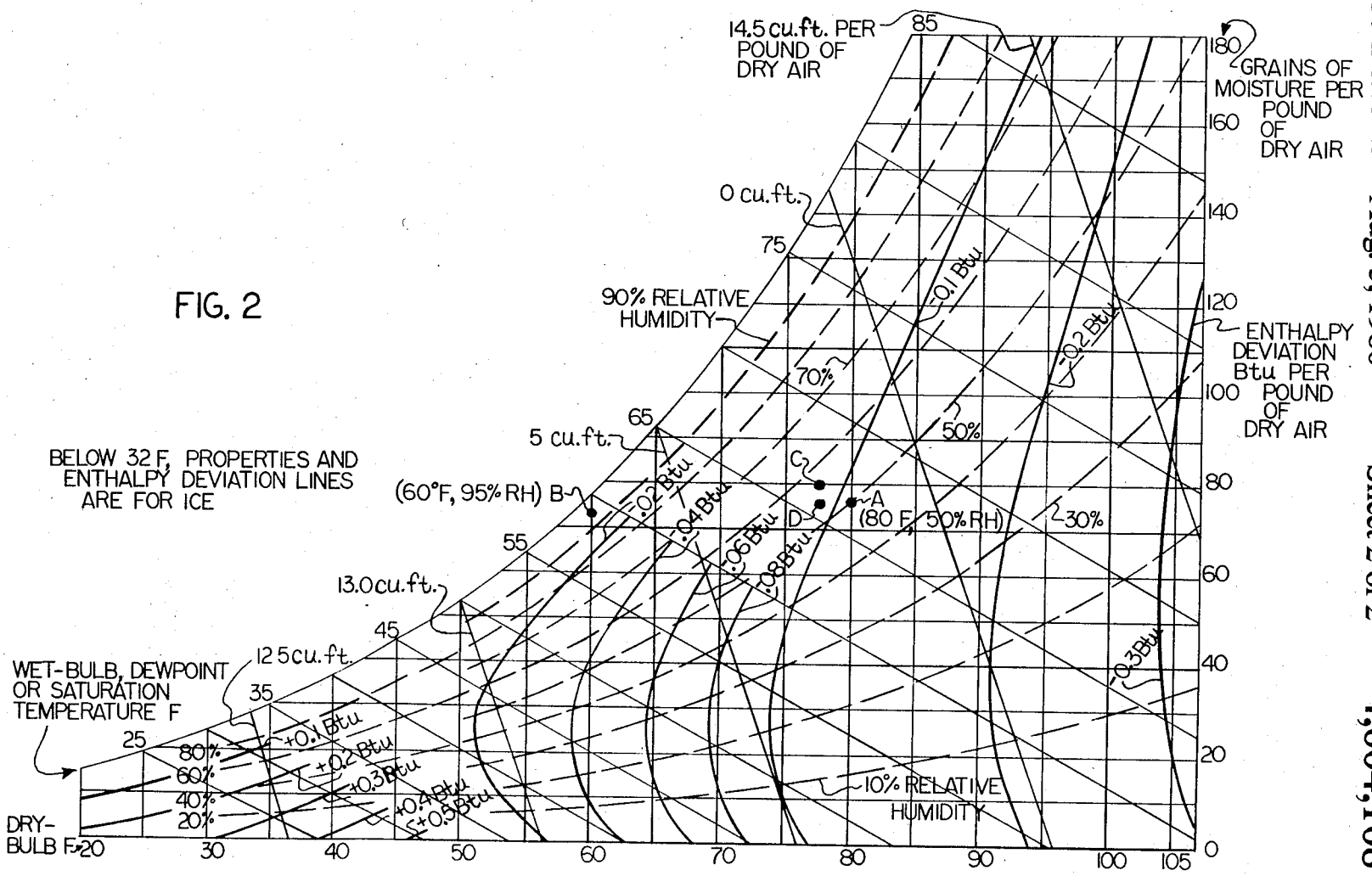
FIG. 2 is a phychrometric chart illustrative of the condition of the air both as it enters and as it leaves the air washer of the present invention.

Referring now to FIG. 2, there is illustrated on a phychrometric chart the effect of the present invention on the return air. The return air is designated at point A (80° F.,50% R.H.) on the phychrometric chart in FIG. 2 and it enters the air treatment housing 14 in the condition there illustrated. Since the air in the upper regions of air treatment housing 14 immediately downstream of the air washer 20 is unaffected, it remains at the same point. The air in the lower regions of the air treatment housing 14 immediately downstream of the air washer 20 is in the condition illustrated at point B (60° F., 95% R.H. cooler, but at only slightly less absolute humidity). Therefore, when the air is again mixed, the resulting air returned to the served area 10 will be dehumidified, but only to a minimum degree.

Contrary, if the return air is treated as has been proposed in prior art devices described hereinabove (by throttling the spray throughout or by introducing the minimum spray in the upper regions of the air treatment housing 14) an actual increase in absolute humidity due to evaporative cooling takes place. This condition is noted at point C of FIG. 2 and is highly undesirable, because as the air continually passes through the work area 10 it picks up moisture and when processed through the air treatment housing 14, it again picks up moisture. Therefore it is seen that, particularly in instances where moisture control is critical, it just cannot be obtained during minimal dehumidification situations. It is believed that the present invention overcomes this nagging problem in the industry.

While a preferred embodiment has been described in detail hereinabove, it is believed that various changes might be made in the approach described in detail without departing from the scope of the present invention, which is set forth in the following claims.

What is claimed is:

1. A spray washer apparatus of the type placed in the return air stream which is moving from a served work area to an air treatment area, of which the spray washer forms a part thereof, before being returned to the work area, said apparatus comprising:

(a) a chilled water source;

(b) at least one bank of spray nozzles connected to said water source, said nozzles receiving chilled water from said source and atomizing said water into said return air stream;

(c) said bank of nozzles being divided into a first upper set of nozzles, and a second lower set of nozzles;

(d) means for dividing the water from said water source into two paths, a first path being directed to said upper set of nozzles and a second path being directed to said lower set of nozzles; and a temperature sensing device in the work area;

(e) a throttling valve positioned in the path between said source of chilled water and said upper set of nozzles for automatically reducing water pressure to said upper set of said nozzles responsive to said temperature sensing device, the water pressure to said upper set being reduced without affecting the water pressure provided to said lower set of nozzles;

(f) whereby said upper set of nozzles may be throttled or closed during minimum spray conditions while simultaneously delivering water to said lower nozzles at sufficient pressure to atomize the water into said air stream.

2. The apparatus according to claim 1 wherein said lower set of nozzles comprise 10–15 percent of the total number of nozzles.

3. The apparatus according to claim 1 wherein said temperature sensing device comprises a dry bulb thermostat.

4. The apparatus according to claim 1 wherein said means for dividing the water from said water source includes a first header connected to said upper set of nozzles, and a second header connected to said lower set of nozzles, said first and second headers being also connected to said water source.

5. A method for introducing a reduced supply of water through a bank or banks of nozzles in an air washer into a return air stream which is moving from a work area to an air treatment area, said method comprising the steps of:

(a) continuously monitoring the room dry bulb temperature of the work area;

(b) modulating the amount of atomized water which is emitted by said nozzles into the return air stream when the temperature drops below a prescribed level, said modulating effect being created by:

(i) throttling the amount of water to a first upper set of said bank of nozzles until the temperature rises past said prescribed point, while (ii) simultaneously maintaining a prescribed pressure to a lower set of said bank of nozzles to effect atomization of water therethrough at a level of atomization greater than that through said upper set of nozzles;

(c) whereby some atomized water is always delivered through the lower set of said nozzles but at times of minimum spray requirements, the spray delivered through the upper set is reduced or eliminated.

* * * * *